United States Patent [19]

Hodge et al.

[11] Patent Number: 4,598,988

[45] Date of Patent: Jul. 8, 1986

[54] FILM DEVELOPING TUBE

[76] Inventors: Dean R. Hodge, Star Rte. 3 Box 133-1; Daryl L. Culler, Star Rte. 3 Box 133-2, both of Cedarcreek, Mo. 65627

[21] Appl. No.: 653,602

[22] Filed: Sep. 24, 1984

[51] Int. Cl.[4] ..... G03D 13/04

[52] U.S. Cl. ..... 354/312; 354/331; 354/338

[58] Field of Search ..... 354/307, 312, 313, 314, 354/323, 329, 330, 331, 337, 338

[56] References Cited

U.S. PATENT DOCUMENTS

| | | | |
|---|---|---|---|
| 2,638,829 | 5/1953 | Singer | 354/313 |
| 3,192,847 | 7/1965 | Erner | 354/337 |
| 3,668,997 | 6/1972 | Ratowsky | 354/330 |
| 3,847,477 | 11/1974 | Haar | 354/312 |
| 4,211,481 | 7/1980 | Bernhardt | 354/312 |
| 4,346,979 | 8/1982 | Faubert | 354/307 |
| 4,350,430 | 9/1982 | Johnson | 354/330 |
| 4,355,879 | 10/1982 | Faubert | 354/329 |

*Primary Examiner*—A. A. Mathews

*Attorney, Agent, or Firm*—David C. Larson

[57] ABSTRACT

A film developing tube for developing roll film is provided. The preferred embodiment is a tubular developing tank with a light trap incorporated at one end which allows the reagents to be easily and efficiently cycled over the film with no requirement of total darkness once the film has been loaded into the tube.

7 Claims, 4 Drawing Figures

FILM DEVELOPING TUBE

BACKGROUND OF THE INVENTION

The present invention relates generally to film developing apparatuses and more particularly to a tubular film development tank which allows simplified and efficient development of roll film.

For home photographers, film development of roll film has typically required the use of a plastic or stainless steel tank with a spool-shaped reel insert for securing the film. Although the tank and reel method was an improvement over the standard open tray method for home photographers using reel film, some difficulties with development remain. A particular problem is the loading of the reel. During the loading process the film can easily be scratched, buckled or marred, and often times it requires multiple attempts to get the film properly loaded onto the reel. This is especially true for the beginning photographer who is not accustomed to working under total darkness conditions. Another difficulty with the tank and reel is uneven agitation of the chemicals over the film due to the spiral nature of the reel and streaking due to the reel spokes. Additionally, the reel configuration is condusive to bubble formation in the chemicals during aggitation which can adhere to the film and cause spotting.

Home photography and film developing is continually gaining in popularity and as procedures and equipment become more simplified and efficient, more people can take advantage of this educational hobby. There is an ever increasing need for easy to use and inexpensive home photography equipment.

SUMMARY OF THE INVENTION

Accordingly, the present invention provides a tube shaped film development tank with a light trap incorporated at one end primarily designed for home photography use.

An object of the present invention is to provide a time saving film developing tank for roll film.

Another object of the invention is to provide a simplified, easy to use film developing apparatus.

A further object is to provide a film developing tank with more consistant film development results through improved aggitation.

Still another object is to provide a film development tank that minimizes the possibility of film damage.

Yet another object is to provide a film developing tank that economizes on the amount of chemicals required to complete the developing process.

Yet a further object is to provide a film developing tank which can be constructed from standard materials.

Other objects, advantages and novel features of the present invention will become apparent from the following detailed description of the invention when considered in conjunction with the accompanying drawings.

DESCRIPTION OF THE PREFERRED EMBODIMENT

Figure 1:
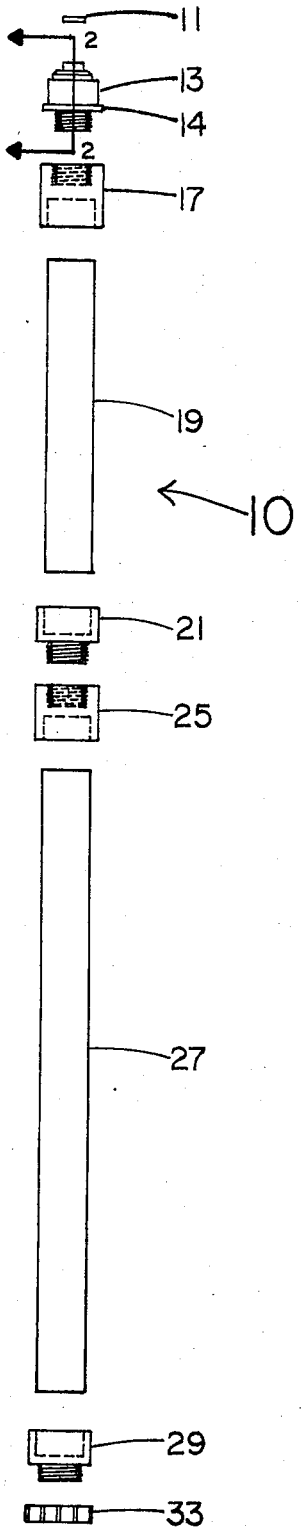
FIG. 1 is an exploded view of the film development tube of the present invention.

Referring now to the drawings wherein like reference numerals designate identical or corresponding parts throughout the several views, FIG. 1 shows the film developing tube of the present invention indicated generally at 10. The film developing tube 10 includes a bottom cap 33 which cooperates with a male fitting 29 to removably seal the bottom end of a primary tube 27. It is understood that the bottom cap 33 could removably attach directly to the primary tube 27 without detracting from the spirit of the invention. Additionally, the bottom cap 33 could be permanently fixed to the primary tube 27 without extirpating the utility of the invention.

A female fitting 25 removably attaches to the top end of the primary tube 27 and cooperates with a male fitting 21 which in turn removably attaches to the bottom end of an extension tube 19 to connect the primary tube 27 to the extension tube with the joint having a smooth, obstruction free interior. Alternative joint structures such as collars (not shown) or bell-end attachments (not shown) would also be acceptable so long as the interior of the joint is smooth and obstruction free allowing for film to slide through as will be more fully explained below.

A female fitting 17 removably attaches to the top end of the extension tube 19 and provides a cooperating receptical for a light trap 13 which results in a smooth, obstruction free interior surface at the location of juncture in a manner homogeneous to the joint structure between the primary tube 27 and the extension tube 19. Similarly, other connecting structures which would attach the light trap 13 to the extension tube 19 in a like manner as indicated for the primary tube 27 to extension tube 19 would be equally acceptable. A top cap 11 removably attaches to the top of the light trap 13 providing a removable seal for top end of the film developing tube 10.

All of the connections and joints, from the bottom cap 33 to the top cap 11, are required to be watertight and it is understood that washers, gaskets or other joint sealers (not shown for simplicity) can be used to insure leak stoppage.

By removing the male fitting 21, the extention tube 19 and the female fitting 17, the light trap 13 can be attached to the female fitting 25 thereby shortening the overall length of the film developing tube 10. Depending upon the number of frames on the film being developed, the film developing tube length can be altered to compensate for different film lengths due to different exposure numbers. From the foregoing, it can be understood that it is important that the structure for connecting the extension tube 19 to the primary tube 27 be interchangeable with the structure for connecting the light trap 13 to the extension tube 19.

Figure 2:
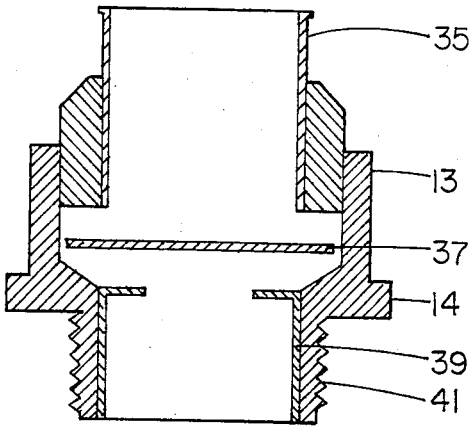
FIG. 2 is a section view of the light trap portion of the present invention taken along line 2—2.

The light trap 13 functions to allow the filling and the draining of the film developing tube 10 with the various film developing chemicals used in the development process without allowing light to pass into the film developing tube 10. As best can be seen in FIG. 2, the light trap 13 works on the principle that liquid can flow around corners, but light cannot bend around corners. A non-reflective throat 35 serves to receive the various film developing chemicals while minimizing splashback and minimizing the light angle entering the light trap 13. After the film developing chemicals pass through the upper light trap 35, they flow around a nonreflective light stop 37 and pass through a nonreflective insert 39 before entering the film developing tube 10. The nonreflective light stop 37 is held in place by a plurality of connecting tabs which secure the light stop 37 to the interior of the light trap 13. The throat 35, the light stop 37, and the insert 39 cooperate in forming a series of sharp angles which prohibit light from entering into the film developing tube 10.

Shown on the exterior of the light trap 13 is a rim 14 which prohibits any spilled film developing chemcials from adhering to the outside of the film developing tube 10 and coming in contact with the hands or clothing of the person developing the film.

In practice, the invention is used by sliding an undeveloped roll of film lengthwise into the film developing tube 10 in a manner similar to unrolling a measuring tape. Once the film is loaded, the light trap 13 is placed on the film developing tube 10 and the balance of the film developing process, as well known in the art, can then take place out of the dark room.

Figure 3:
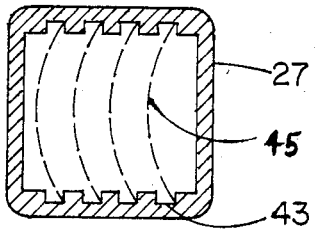
FIG. 3 is a section view of the film development tube.
Figure 4:
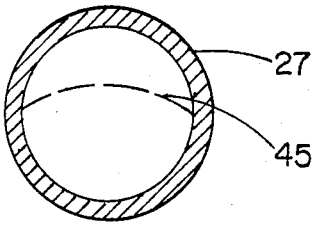
FIG. 4 is an alternative embodiment of the section view of the film development tube.

Shown in FIG. 3, and FIG. 4, are two alternative embodiments of the cross-section of the film developing tube 10. A rectangle cross-section is shown in FIG. 3, which contains grooves 43 into which the film 45 can be loaded. This embodiment enables the pocessing of multiple rolls of film at the same time. A circular cross-section is shown in FIG. 4. wherein the film 45 is slid into a diameter approximating the width of the film. It is understood that different size cross-sections would be required in the processing of different width films although the princple remains the same.

I claim:

1. A film developing tube apparatus for developing roll film comprising:

a non-flexible, opaque primary tube having an inside transverse dimension equal to or slightly less than the width of the roll film to be developed and having a longitudinal dimension equal to or slightly more than the unrolled length of the film to be developed for containing roll film in a longitudinally extended disposition during development;

a non-flexible, opaque extension tube have an inside transverse dimension matching the inside transverse dimension of the primary tube for adding to the length of the film developing tube when necessary, for longer than standard roll film lengths;

connection means for cooperatively joining the primary tube and extension tube;

cap means removably attached to the lower end of the primary tube;

light trap means capable of being removably attached to either the upper end of the primary tube or the upper end of the extension tube; and cap means removably attached to the upper end of the light trap means.

2. A film developing tube apparatus as recited in claim 1, wherein said light trap means comprises:

a non-reflective throat;

a non-reflective light stop; and a non-reflective insert, all cooperating to form angles within the light trap means for allowing the passage of liquid, but prohiting the passage of light into the film developing tube.

3. A film developing tube apparatus as recited in claim 1 wherein the interior cross section of the apparatus is circular.

4. A film developing tube apparatus as recited in claim 1 wherein the cross section of the apparatus is rectangular with a plurality of cooperating grooves on two of the opposing sides for securing the edges of the film within the apparatus.

5. A film developing tube apparatus as recited in claim 2 wherein the cross-section of the apparatus is circular.

6. A film developing tube apparatus as recited in claim 2 wherein the cross-section of the apparatus is rectangular with a plurality of cooperating grooves on two of the opposing sides for securing the edges of the film within the apparatus.

7. A film developing tube for developing roll film comprising:

a nonflexible, opaque primary tube having an inside transverse dimension equal to or slightly less than the width of the roll film to be developed;

a first male fitting removably attached to the lower end of the primary tube;

a bottom cap removably attached to the lower end of the first male fitting;

a nonreflective opaque extension tube having an inside transverse dimension matching the inside transverse dimension of the primary tube for adjusting the length of the film developing tube for adaptation to different roll film lengths;

a first female fitting removably attached to the upper end of the primary tube;

a second male fitting removably attached to the lower end of the extension tube for connecting the extension tube to the first female fitting;

a second female fitting removably attached to the upper end of the extension tube;

light trap means capable of being removably attached to either the first female fitting or to the second female fitting for allowing the passage of liquid, but prohibiting the passage of light into the film developing tube; and a cap removably attached to the upper end of the light trap means.

* * * * *